US009225122B1

(12) United States Patent
Evans et al.

(10) Patent No.: US 9,225,122 B1
(45) Date of Patent: Dec. 29, 2015

(54) CONNECTOR ASSEMBLY HAVING CONDUCTIVE HOLDER MEMBERS

(71) Applicant: Tyco Electronics Corporation, Berwyn, PA (US)

(72) Inventors: Nicholas Lee Evans, Harrisburg, PA (US); Wayne Samuel Davis, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 14/452,737

(22) Filed: Aug. 6, 2014

(51) Int. Cl.
*H01R 13/58* (2006.01)
*H01R 13/6588* (2011.01)

(52) U.S. Cl.
CPC ..... *H01R 13/6588* (2013.01)

(58) Field of Classification Search
CPC ..... H01R 13/6588
USPC ..... 439/65, 66, 74, 607.5, 607.11, 607.02, 439/607.25, 607.07
See application file for complete search history.

(56) References Cited

U.S. PATENT DOCUMENTS 6,609,929 B2 8/2003 Kamarauskas et al.
8,182,289 B2 * 5/2012 Stokoe ..... H01R 12/721 439/607.07
8,616,919 B2 * 12/2013 Stoner ..... H01R 13/6587 439/607.07
8,662,924 B2 * 3/2014 Davis ..... H01R 13/6477 439/607.07
8,747,158 B2 * 6/2014 Szczesny ..... H01R 4/04 439/607.07
8,771,016 B2 * 7/2014 Atkinson ..... H01R 13/6474 439/607.07
8,888,530 B2 * 11/2014 Trout ..... H01R 13/6587 439/607.07
2010/0144204 A1 * 6/2010 Knaub ..... H01R 13/514 439/607.07
2015/0064968 A1 * 3/2015 Davis ..... H01R 13/6587 439/607.02

* cited by examiner

*Primary Examiner* — Abdullak Riyami
*Assistant Examiner* — Nelson R Burgos-Guntin

(57) ABSTRACT

A connector assembly includes a contact module having a conductive holder and a frame assembly held by the conductive holder. The conductive holder includes first and second holder members electrically connected to one another and having a chamber divided into a plurality of channels by first and second tabs. The first tabs have posts extending therefrom and the second tabs having holes receiving the posts with tab segments on opposite sides of the associated holes. Each hole has a bridge extending across the hole between the tab segments that blocks electrical radiation across the hole between the adjacent channels. The frame assembly includes a dielectric frame received in the holder members including a plurality of contacts and frame members supporting the contacts routed through corresponding channels. The first and second tabs are disposed between corresponding frame members and the bridges are disposed between corresponding frame members.

20 Claims, 9 Drawing Sheets

CONNECTOR ASSEMBLY HAVING CONDUCTIVE HOLDER MEMBERS

BACKGROUND OF THE INVENTION

The subject matter herein relates generally to receptacle assemblies having a shielding structure with a plurality of termination points.

Some electrical systems utilize electrical connectors to interconnect two circuit boards, such as a motherboard and daughtercard. In some systems, to electrically connect the electrical connectors, a midplane circuit board is provided with front and rear header connectors on opposed front and rear sides of the midplane circuit board. Other systems electrically connect the circuit boards without the use of a midplane circuit board by directly connecting electrical connectors on the circuit boards.

However, as speed and performance demands increase, known electrical connectors are proving to be insufficient. Signal loss and/or signal degradation is a problem in known electrical systems. Additionally, there is a desire to increase the density of electrical connectors to increase throughput of the electrical system, without an appreciable increase in size of the electrical connectors, and in some cases, with a decrease in size of the electrical connectors. Such increase in density and/or reduction in size causes further strains on performance.

In order to address performance, some known systems utilize shielding to reduce interference between the contacts of the electrical connectors. However, the shielding utilized in known systems is not without disadvantages. For instance, the shielding along the signal channels may be subject to ground induced noise resonances, particularly at higher frequencies. In the presence of isolated ground structures, such ground induced noise resonances lead to pair-to-pair crosstalk.

A need remains for an electrical system that provides efficient shielding to meet particular performance demands.

BRIEF DESCRIPTION OF THE INVENTION

In one embodiment, a connector assembly is provided including a contact module having a conductive holder and a frame assembly held by the conductive holder. The conductive holder includes a first holder member and second holder member coupled to the first holder member. The first and second holder members are electrically connected to one another. The conductive holder has a chamber between the first and second holder members divided into a plurality of channels by first tabs of the first holder member and second tabs of the second holder member. The first tabs have posts extending therefrom and the second tabs having holes receiving the posts of the first tabs. The second tabs have tab segments on opposite sides of the associated holes and each hole has a bridge extending across the hole between the tab segments on opposite sides of the associated hole. The bridge blocks electrical radiation across the hole between the adjacent channels. The frame assembly includes at least one dielectric frame received in the first and second holder members. Each dielectric frame includes a plurality of contacts and frame members supporting the contacts. The contacts are routed through corresponding channels. The first and second tabs are disposed between corresponding frame members and the bridges are disposed between corresponding frame members.

In another embodiment, a connector assembly is provided that includes a contact module having a conductive holder and a frame assembly held by the conductive holder. The conductive holder includes a first holder member and second holder member coupled to the first holder member. The first holder member has a first wall with a plurality of first tabs extending from the first wall toward the second holder member. The first tabs have inner edges facing the second holder member and first posts extending from the inner edges. First channels are defined between each of the first tabs. The second holder member has a second wall with a plurality of second tabs extending from the second wall toward the first holder member. The second tabs have inner edges facing the first holder member. Second channels are defined between each of the second tabs. The second tabs have second holes through the second tabs and bridges extending across the second holes to block the second holes from at least one of the adjacent channels. The bridges block electrical radiation across the corresponding second hole between the adjacent channels. The second holes receive the first posts of the first tabs such that each first post engages portions of the second tab surrounding the corresponding second hole to electrically connect the first and second holder members. The frame assembly includes at least one dielectric frame received in the first and second holder members. Each dielectric frame includes a plurality of contacts and frame members supporting the contacts. The contacts are routed through corresponding channels. The first and second tabs are disposed between corresponding frame members and the bridges disposed between corresponding frame members.

DETAILED DESCRIPTION OF THE INVENTION

Figure 1:
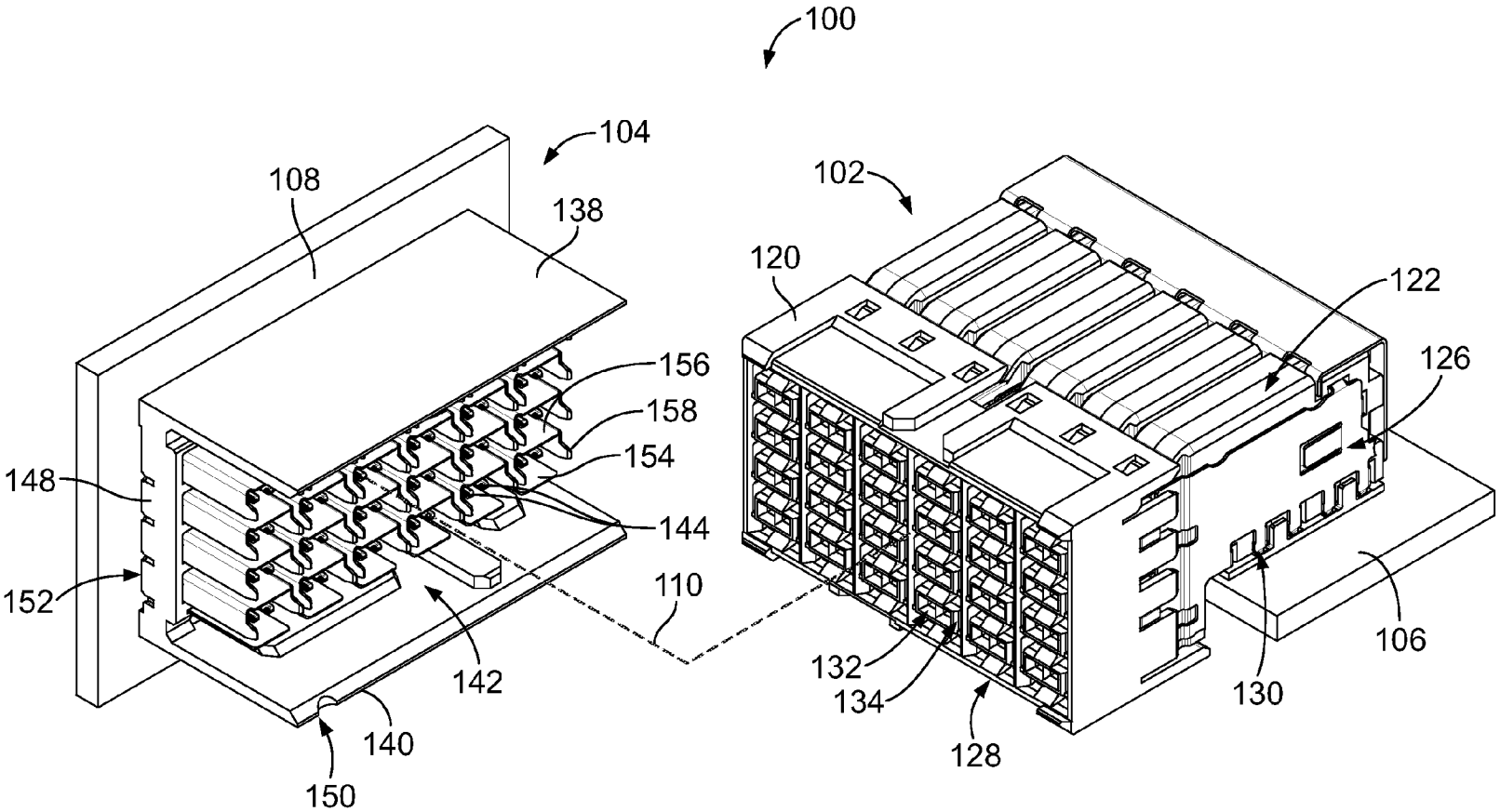
FIG. 1 is a perspective view of an exemplary embodiment of an electrical connector system illustrating a connector assembly and a header assembly.

FIG. 1 is a perspective view of an exemplary embodiment of an electrical connector system 100 illustrating a receptacle assembly 102 and a header assembly 104 that may be directly mated together. The receptacle assembly 102 and/or the header assembly 104 may be referred to hereinafter individually as a "connector assembly" or collectively as "connector assemblies". Other types of connector assemblies may be used in alternative embodiments other than a receptacle assembly or a header assembly. The receptacle and header assemblies 102, 104 are each electrically connected to respective circuit boards 106, 108; however either of the connector assemblies may be cable assemblies having cables terminated to the conductors of the connector assemblies.

The receptacle and header assemblies 102, 104 are mated together in a direction parallel to and along a mating axis 110. The receptacle and header assemblies 102, 104 are utilized to electrically connect the circuit boards 106, 108 to one another at a separable mating interface. In an exemplary embodiment, the circuit boards 106, 108 are oriented perpendicular to one another when the receptacle and header assemblies 102, 104 are mated. Alternative orientations of the circuit boards 106, 108 are possible in alternative embodiments.

The receptacle assembly 102 includes a front housing 120 that holds a plurality of contact modules 122. Any number of contact modules 122 may be provided to increase the number of data channels between the circuit boards 106, 108. The contact modules 122 each include a plurality of receptacle signal contacts 124 (shown in FIG. 2) that are received in the front housing 120 for mating with the header assembly 104.

In an exemplary embodiment, each contact module 122 has a shield structure 126 for providing electrical shielding for the receptacle signal contacts 124. In an exemplary embodiment, the shield structure 126 is electrically connected to the header assembly 104 and/or the circuit board 106. For example, the shield structure 126 may be electrically connected to the header assembly 104 by extensions (e.g. beams or fingers) extending from the contact modules 122 that engage the header assembly 104. The shield structure 126 may be electrically connected to the circuit board 106 by features, such as ground pins. The shield structure 126 may provide shielding along substantially the entire length of the data channels between the circuit boards 106, 108.

The receptacle assembly 102 includes a mating end 128 and a mounting end 130. The receptacle signal contacts 124 are received in the front housing 120 and held therein at the mating end 128 for mating to the header assembly 104. The receptacle signal contacts 124 are arranged in a matrix of rows and columns. Any number of receptacle signal contacts 124 may be provided in the rows and columns. The receptacle signal contacts 124 also extend to the mounting end 130 for mounting to the circuit board 106. Optionally, the mounting end 130 may be substantially perpendicular to the mating end 128.

The front housing 120 includes a plurality of signal contact openings 132 and a plurality of ground contact openings 134 at the mating end 128. The receptacle signal contacts 124 are aligned with corresponding signal contact openings 132 for mating with corresponding header signal contacts 144 when the receptacle and header assemblies 102, 104 are mated. The ground contact openings 134 receive header shields 146 therein when the receptacle and header assemblies 102, 104 are mated. The shield structures 126 of the contact modules 122 are electrically connected with the header shields 146 to electrically common the receptacle and header assemblies 102, 104.

The front housing 120 is manufactured from a dielectric material, such as a plastic material, and provides isolation between the signal contacts 124, 144 and the header shields 146 and/or shield structure 126. The front housing 120 isolates each set of receptacle and header signal contacts 124, 144 from other sets of receptacle and header signal contacts 124, 144.

The header assembly 104 includes a header housing 138 having walls 140 defining a chamber 142. The header assembly 104 has a mating end 150 and a mounting end 152 that is mounted to the circuit board 108. Optionally, the mounting end 152 may be substantially parallel to the mating end 150. The receptacle assembly 102 is received in the chamber 142 through the mating end 150. The front housing 120 engages the walls 140 to hold the receptacle assembly 102 in the chamber 142. The header signal contacts 144 and the header shields 146 extend from a base wall 148 into the chamber 142. The header signal contacts 144 and the header shields 146 extend through the base wall 148 and are mounted to the circuit board 108.

In an exemplary embodiment, the header signal contacts 144 are arranged as differential pairs. The header shields 146 are positioned between the differential pairs to provide electrical shielding between adjacent differential pairs. In the illustrated embodiment, the header shields 146 are C-shaped and provide shielding on three sides of the corresponding pair of header signal contacts 144. The header shields 146 have a plurality of walls, such as three planar walls 154, 156, 158. The walls 154, 156, 158 may be integrally formed or alternatively, may be separate pieces. The wall 156 defines a center wall or top wall of the header shields 146. The walls 154, 158 define side walls that extend from the center wall 156. The header shield 146 associated with another pair of header signal contacts 144 provides shielding along the open, fourth side of the header shield 146 such that each of the pairs of signal contacts 144 is shielded from each adjacent pair in the same column and the same row. Other configurations or shapes for the header shields 146 are possible in alternative embodiments. More or less walls may be provided in alternative embodiments. The walls may be bent or angled rather than being planar. In other alternative embodiments, the header shields 146 may provide shielding for individual signal contacts 144 or sets of contacts having more than two signal contacts 144.

Figure 2:
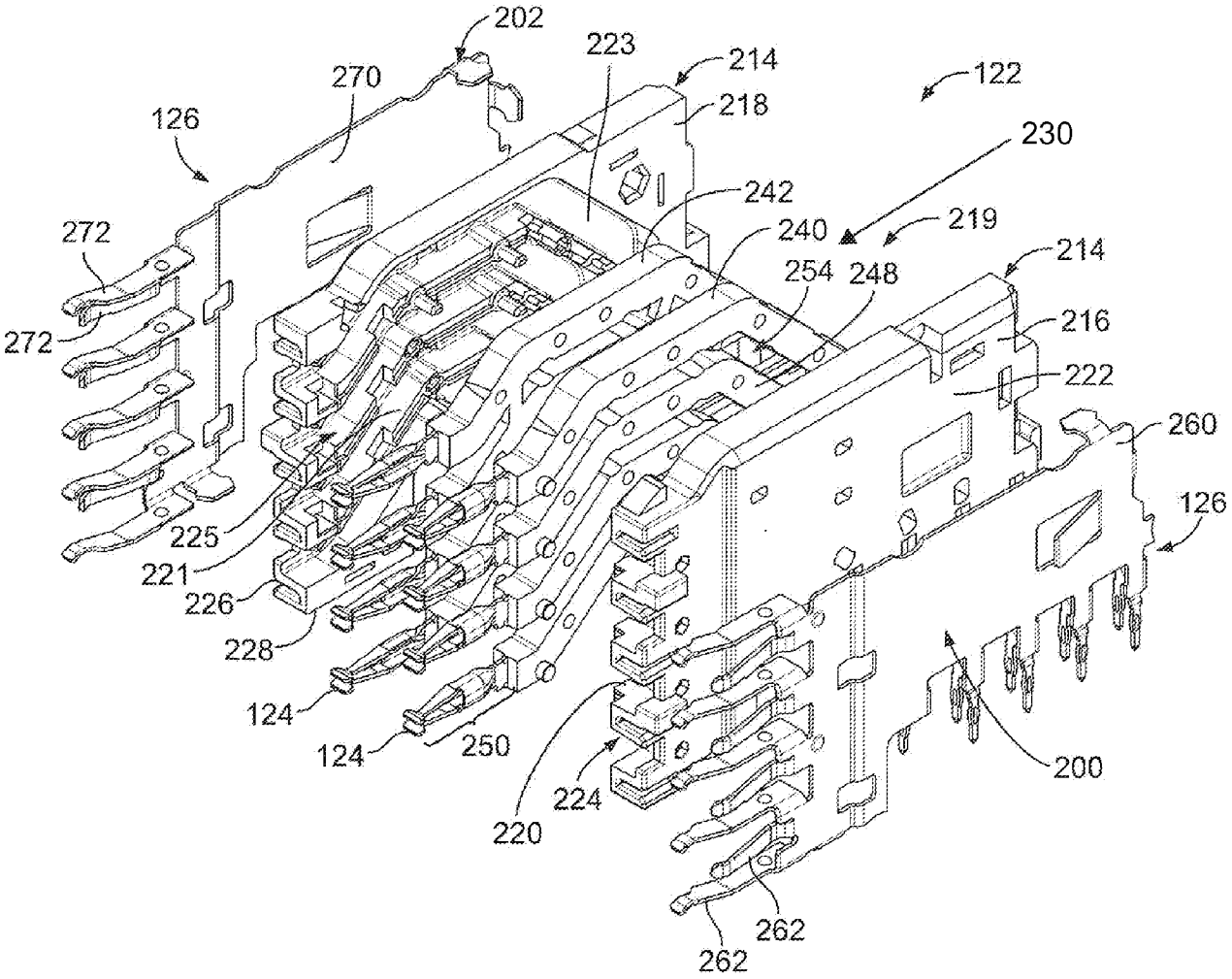
FIG. 2 is an exploded view of one of the contact modules and part of a shield structure shown in FIG. 1.

FIG. 2 is an exploded view of one of the contact modules 122 and part of the shield structure 126. The shield structure 126 includes a first ground shield 200 and a second ground shield 202. The first and second ground shields 200, 202 electrically connect the contact module 122 to the header shields 146 (shown in FIG. 1). The first and second ground shields 200, 202 provide multiple, redundant points of contact to the header shield 146. The first and second ground shields 200, 202 provide shielding on all sides of the receptacle signal contacts 124.

The contact module 122 includes a holder 214 having a first holder member 216 and a second holder member 218 that are coupled together to form the holder 214. When the holder members 216, 218 are coupled together, the first and second holder members 216, 218 define a chamber 219 that receives receptacle signal contacts 124. The holder members 216, 218 are fabricated from an electrically conductive material. For example, the holder members 216, 218 may be fabricated from a plastic material that has been metalized, plated or coated with a metallic layer. Alternatively, the holder members 216, 218 may be stamped and formed or may be die-cast from a metal material. By having the holder members 216, 218 fabricated from an electrically conductive material, the holder members 216, 218 may provide electrical shielding for the receptacle assembly 102. When the holder members 216, 218 are coupled together, the holder members 216, 218 define at least a portion of the shield structure 126 of the receptacle assembly 102. The ground shields 200, 202 are mechanically and electrically connected to the holder members 216, 218, respectively.

The first and second holder members 216, 218 include first and second tabs 220, 221 extending inward toward one another from first and second walls 222, 223 of the holder members 216, 218, respectively. The tabs 220 define channels 224 therebetween. The tabs 221 define channels 225 therebetween. The tabs 220, 221 define at least a portion of the shield structure 126 of the receptacle assembly 102. The ground shields 200, 202 are attached to the first and second walls 222, 223, respectively.

When assembled, the holder members 216, 218 are coupled together and define a front 226 and a bottom 228 of the holder 214. The holder members 216, 218 are mechanically and electrically connected at multiple, redundant points of contact within the contact module 122 to create a reliable electrical connection therebetween at regular intervals. The multiple points of contact at regular intervals reduce low frequency noise resonance effects to control near end and/or far end cross talk and improve signal performance. The intervals can be selected to reduce the noise in certain ranges or below a certain threshold. For example, the intervals may be selected to reduce noise resonance effects at below 12.5 GHz. The intervals may be selected to reduce noise resonance effects at higher frequency ranges if desired.

The contact module 122 includes a frame assembly 230 held by the holder 214. The frame assembly 230 includes the receptacle signal contacts 124. The frame assembly 230 includes a pair of dielectric frames 240, 242 surrounding the receptacle signal contacts 124. In an exemplary embodiment, the receptacle signal contacts 124 are initially held together as lead frames (not shown), which are overmolded with dielectric material to form the first and second dielectric frames 240, 242. Manufacturing processes other than overmolding a leadframe may be utilized to form the contact modules 122, such as loading receptacle signal contacts 124 into a formed dielectric body.

The dielectric frame 240 includes a plurality of frame members 248. Each frame member 248 is formed around a different receptacle signal contact 124. Stated differently, each receptacle signal contact 124 extends along, and inside of, a corresponding frame member 248. The frame members 248 encase the receptacle signal contacts 124. The receptacle signal contacts 124 have mating portions 250 extending from the fronts and contact tails 252 extending from the bottoms of the frame members 248. Other configurations are possible in alternative embodiments. Inner portions or encased portions of the receptacle signal contacts 124 transition between the mating portions 250 and the contact tails 252 within the dielectric frame 240.

The dielectric frame 240 includes a plurality of windows 254 extending through the dielectric frame 240 between the frame members 248. The windows 254 separate the frame members 248 from one another. In an exemplary embodiment, the windows 254 extend entirely through the dielectric frame 240. The windows 254 are internal of the dielectric frame 240 and located between adjacent receptacle signal contacts 124, which are held in the frame members 248. The windows 254 extend along lengths of the receptacle signal contacts 124 between the contact tails 252 and the mating portions 250. Optionally, the windows 254 may extend along a majority of the length of each receptacle signal contact 124 measured between the corresponding contact tail 252 and mating portion 250.

During assembly, the first dielectric frame 240 and corresponding receptacle signal contacts 124 are coupled to the first holder member 216. The frame members 248 are received in corresponding channels 224. The first tabs 220 are received in corresponding windows 254 such that the tabs 220 are positioned between adjacent receptacle signal contacts 124. The tabs 220 provide electrical shielding between the receptacle signal contacts 124 on either side of the tabs 220.

The second dielectric frame 242 is manufactured in a similar manner as the first dielectric frame 240 and includes similar components. The second dielectric frame 242 and corresponding receptacle signal contacts 124 are coupled to the second holder member 218 in a similar manner with the second tabs 221 extending through the windows 254 in the second dielectric frame 242. When the first and second dielectric frames 240, 242 are arranged in the holder members 216, 218, the receptacle signal contacts 124 are arranged as differential pairs. The tabs 220, 221 extend through the dielectric frames 240, 242 to provide shielding between the differential pairs of receptacle signal contacts 124. The first and second tabs 220, 221 have multiple points of contact therebetween to ensure electrical continuity of the shield structure 126 along the entire lengths of the receptacle signal contacts 124.

The holder members 216, 218, which are part of the shield structure 126, provide electrical shielding between and around respective receptacle signal contacts 124. The holder members 216, 218 provide shielding from electromagnetic interference (EMI) and/or radio frequency interference (RFI). The holder members 216, 218 may provide shielding from other types of interference as well. The holder members 216, 218 provide shielding around the outside of the frames 240, 242 and thus around the outside of all of the receptacle signal contacts 124, such as between pairs of receptacle signal contacts 124, as well as between the receptacle signal contacts 124 using the tabs 220, 221 to control electrical characteristics, such as impedance control, cross-talk control, and the like, of the receptacle signal contacts 124.

The first ground shield 200 includes a main body 260 configured to be coupled to the first wall 222 of the first holder member 216. The ground shield 200 includes grounding beams 262 extending forward from the main body 260. The grounding beams 262 are used to electrically connect the shield structure 126 to the corresponding header shield 146 (shown in FIG. 1). In an exemplary embodiment, the first ground shield 200 is manufactured from a metal material. The ground shield 200 is a stamped and formed part with the grounding beams 262 being stamped and formed out of plane with respect to the main body 260.

The second ground shield 202 includes a main body 270 configured to be coupled to the second wall 223 of the second holder member 218. The ground shield 202 includes grounding beams 272 extending forward from the main body 270. The grounding beams 272 are used to electrically connect the shield structure 126 to the corresponding header shield 146 (shown in FIG. 1). In an exemplary embodiment, the second ground shield 202 is manufactured from a metal material. The ground shield 202 is a stamped and formed part with the grounding beams 272 being stamped and formed out of plane with respect to the main body 270.

Figure 3:
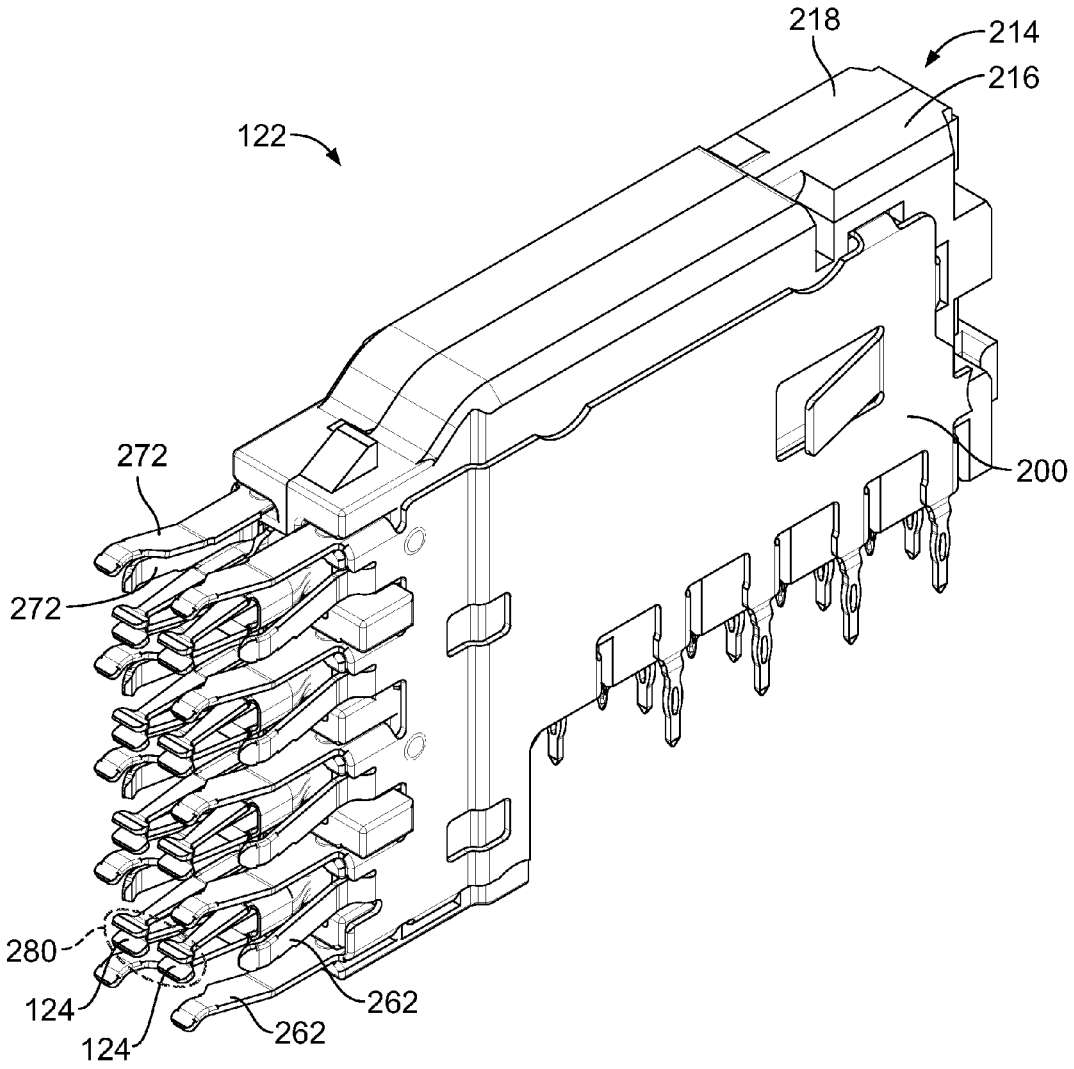
FIG. 3 illustrates one of the contact modules in an assembled state.

FIG. 3 illustrates one of the contact modules 122 in an assembled state. During assembly of the contact module 122, the dielectric frames 240, 242 (shown in FIG. 2) are received in the corresponding holder members 216, 218. The holder members 216, 218 are coupled together and generally surround the dielectric frames 240, 242. With the dielectric frames 240, 242 aligned adjacent one another in the holder 214, the receptacle signal contacts 124 are aligned with one another and define contact pairs 280. Each contact pair 280 is configured to transmit differential signals through the contact module 122.

The first and second ground shields 200, 202 (second ground shield 202 being shown in FIG. 2) are coupled to the holder 214 to provide shielding for the receptacle signal contacts 124. The grounding beams 262, 272 extend along the receptacle signal contacts 124. The first and second ground shields 200, 202 are configured to be electrically connected to the header shields 146 (shown in FIG. 1) when the receptacle assembly 102 is coupled to the header assembly 104 (shown in FIG. 1).

Figure 4:
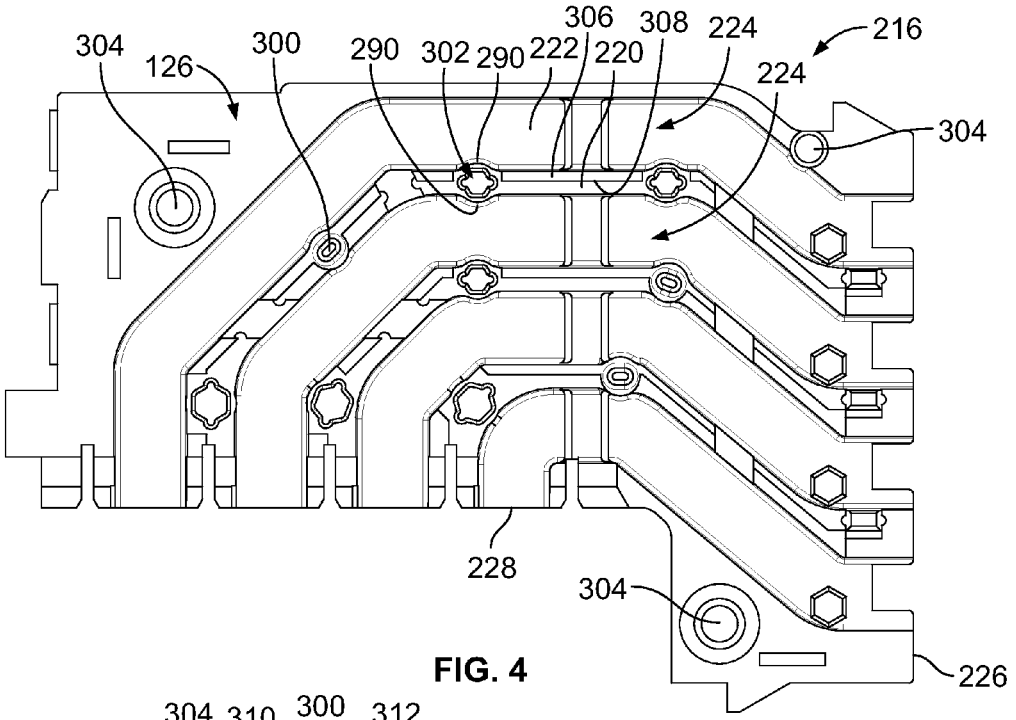
FIG. 4 is a side view of a holder member of the contact module formed in accordance with an exemplary embodiment.
Figure 5:
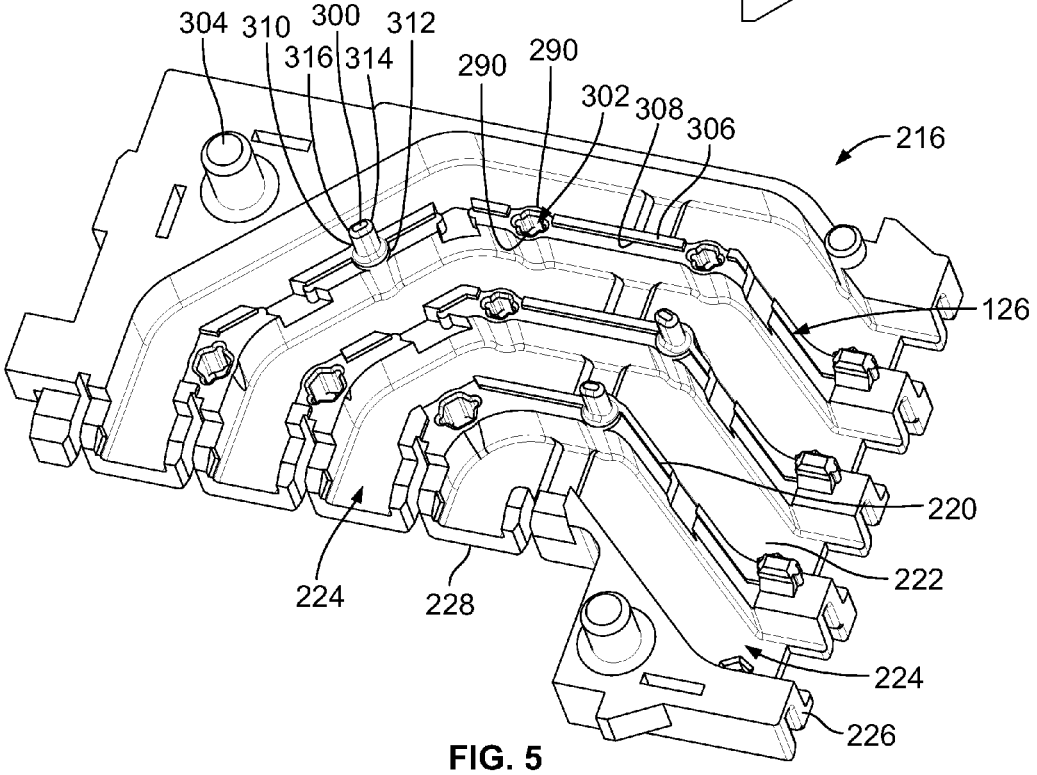
FIG. 5 is a perspective view of the holder member.

FIG. 4 is a side view of the first holder member 216 formed in accordance with an exemplary embodiment. FIG. 5 is a perspective view of the first holder member 216. FIGS. 4 and 5 illustrate the first tabs 220 extending from the first wall 222 to define the corresponding channels 224. The first tabs 220 and channels 224 transition between the front 226 and bottom 228 of the first holder member 216.

In an exemplary embodiment, the first holder member 216 includes a plurality of connection features that mechanically and electrically connect the first holder member 216 to the second holder member 218 (shown in FIG. 2). The multiple connection features create a reliable electrical connection between the first and second holder members 216, 218 to ensure that the shielding structure 126 is electrically commoned at regular intervals to reduce the ground induced noise resonances that can be present in pair-to-pair cross talk. Having multiple electrical connections reduces the presence of isolated ground structures around the receptacle signal contacts, which may enhance the electrical performance of the receptacle assembly 102 (shown in FIG. 1). Additionally, the first holder member 216 includes electrical radiation reducing features that reduce electrical radiation between channels 224. For example, bridges 290 block any openings or gaps in the tabs 220 between channels 224. The bridges 290 may make the tabs 220 continuous from the front 226 to the bottom 228. Such electrical radiation reducing features reduce noise resonances between receptacle signal contacts 124 (shown in FIG. 3) in adjacent channels 224 as compared to contact modules that have gaps, spaces or holes in the tabs that would allow electrical radiation therethrough. As such, the electrical radiation reducing features improve performance of the contact module 122 (shown in FIG. 3) as compared to contact modules that have gaps, spaces or holes in the tabs.

In an exemplary embodiment, the connection features include first posts 300 arranged at intervals along the first tabs 220 and first holes 302 arranged at intervals along the first tabs 220. The intervals of the first posts 300 and first holes 302 may not be equidistant along any particular first tab 220 or from one tab 220 to another tab 220, but rather may be arranged at intervals that are less than a preselected maximum interval. The maximum interval is selected to reduce or eliminate frequency noise resonance effects in a particular frequency range or below a predetermined frequency, such as below 12.5 GHz. Having a shorter maximum interval generally increases the frequency below which frequency noise resonance effects are reduced. For example, further decreasing of the spacing between the connection features may reduce frequency noise resonance effects below 12.5 GHz, below 20 GHz, or below other targeted frequencies. Any desired frequency range may be targeted and the corresponding spacing between the connection features may be set accordingly.

The first posts 300 are configured to be received in corresponding holes 322 (shown in FIG. 7) in the second holder member 218 while the first holes 302 are configured to receive corresponding posts 320 (shown in FIG. 7) extending from the second holder member 218, as described in further detailed below. The posts 300 and holes 302 may be arranged in any sequence, such as an alternating sequence of post-hole-post-hole along the first tab 220. Other sequences are possible in alternative embodiments. Optionally, portions of the first tab 220 may be wider, such as along the bottom, and in such portions the posts 300 and holes 302 may be enlarged, which may allow the posts 300 to be more robust and reduce the risk of damage. For example, the first tabs 220 may have different thickness along different sections thereof, with the thickness dimension generally defined across the tab 220 between the adjacent channels 224 on either side of the corresponding tab 220.

Optionally, in an alternative embodiment, the first holder member 216 may include only posts 300 or only holes 302. Optionally, the first holder member 216 may include different sized and shaped posts 300 and holes 302 along the first tabs 220. Optionally, the first holder member 216 may include connection features in locations other than along the first tabs 220. For example, in the illustrated embodiment, the first holder member 216 includes outer posts 304 along surfaces of the first holder member 216 outside of the area of the first tabs 220.

In an exemplary embodiment, the connection features include first shoulders 306 along the first tabs 220. Each first shoulder 306 may be provided along the upper half of the corresponding first tab 220 and include a downward facing surface 308 that is configured to engage a corresponding shoulder of the second holder member 218. The first shoulders 306 may engage the second holder member 218 to create mechanical and/or electrical connection between the first holder member 216 and the second holder member 218.

The first posts 300 have an outer perimeter 310. Optionally, the first posts 300 may be oblong or oval in shape. Alternatively, the first posts 300 may have other shapes, such as circular, rectangular or other shapes. The first posts 300 may be elongated along the length of the tab 220, with the length of the tab 220 being defined in a direction generally parallel to the channels 224. The posts 300 may be tapered. For example, each post 300 may be wider at a base 312 of the post 300 and narrower at a tip 314 of the post 300. The posts 300 may have chamfered lead-ins 316 at the tip 314 to help guide the posts 300 into the corresponding holes 322.

Figure 6:
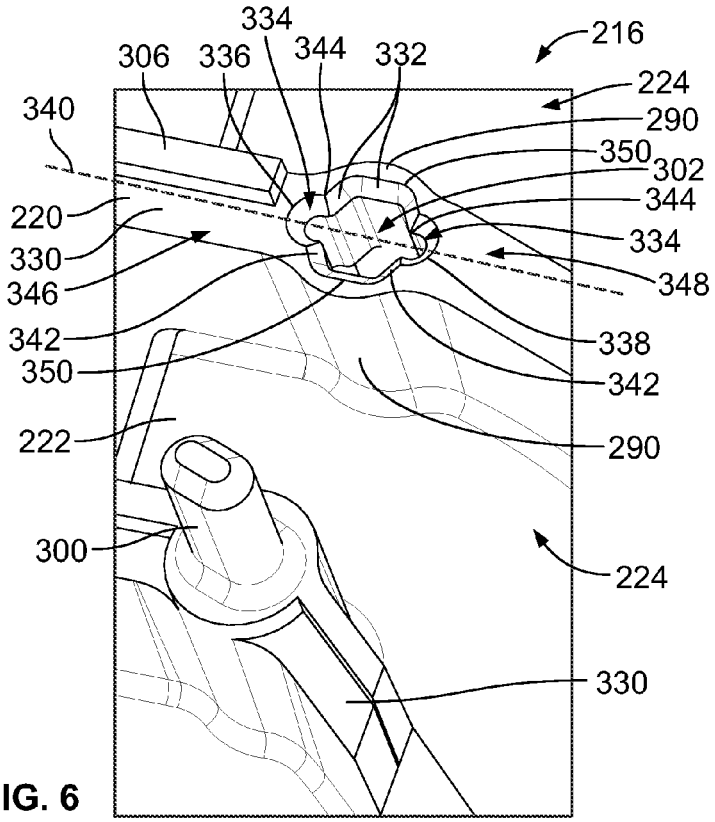
FIG. 6 illustrates a portion of the holder member shown in FIG. 4.

FIG. 6 illustrates a portion of the first holder member 216 showing one of the first posts 300 and one of the first holes 302. The second posts 320 and second holes 322 (both shown in FIG. 7) may be similar to the first posts 300 and first holes 302, respectively.

The first tabs 220 extend inward from the first wall 222 to an inner edge 330. The first shoulders 306 extend from the inner edge 330. The first post 300 extends from the inner edge 330. In the illustrated embodiment, the first post 300 has an oval cross section. However, other shapes are possible in alternative embodiments. The first post 300 is sized and shaped to fit in the corresponding second hole 322 when the first holder member 216 is coupled to the second holder member 218 (shown in FIG. 7). The first post 300 is an integral part of the first holder member 216 and may be co-molded or co-formed with other portions of the first holder member 216, such as the first tab 220 and the first wall 222.

Figure 7:
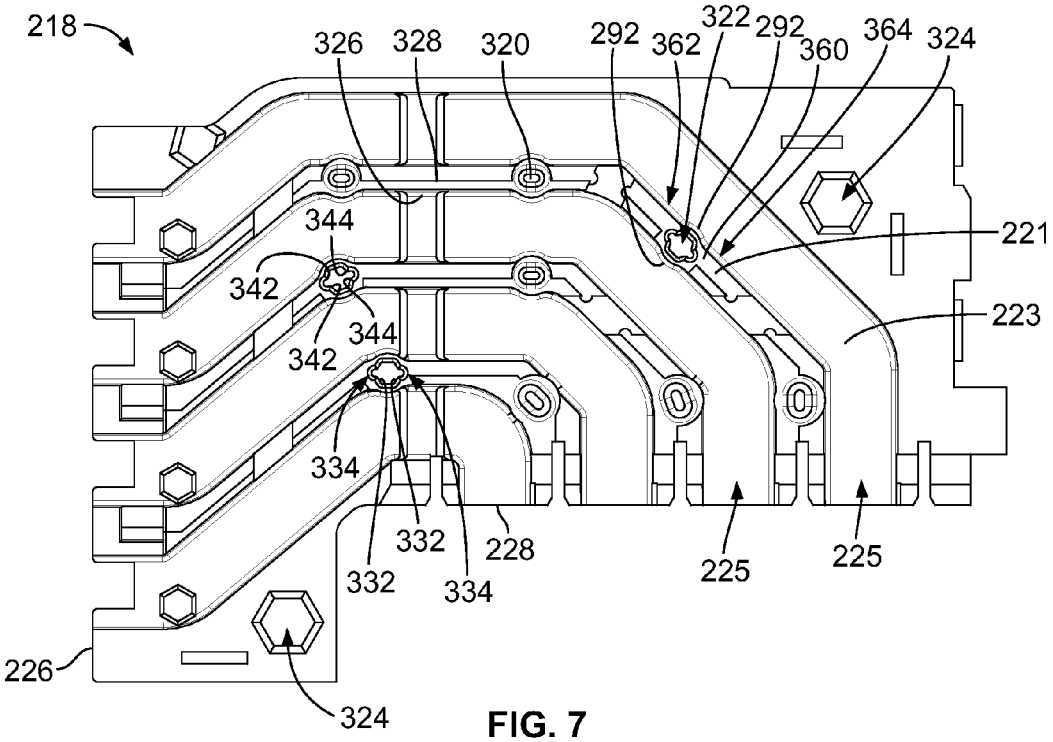
FIG. 7 is a side view of another holder member formed in accordance with an exemplary embodiment.

The first hole 302 is sized and shaped to receive one of the second posts 320 (shown in FIG. 7). In an exemplary embodiment, the first hole 302 is generally hexagonally shaped bounded by a plurality of flat walls 332; however other polygonal shaped holes may be used in alternative embodiments having a different number of flat walls 332. The first hole 302 includes undercuts 334 at opposite sides 336, 338 of the first hole 302. The undercuts 334 are aligned along a longitudinal axis 340 of the first hole 302, which generally runs along the length of the first tab 220, such as parallel to the channels 224. The undercuts 334 provide void spaces for the first hole 302. For example, when the second post 320 is loaded in the corresponding first hole 302, the second post 320 may be compressed and the undercuts 334 provide a space for the second post 320 to swell into, which may relieve pressure or stress in the second post 320, such as to reduce the risk of damage to the second post 320 or to the first tab 220.

Interference tabs 342 are defined at the intersections between the flat walls 332 and the undercuts 334. The interference tabs 342 are configured to engage the second post 320 received in the first hole 302. The interference tabs 342 define termination points 344 between the first holder member 216 and the second holder member 218 (shown in FIG. 7). Each second post 320 is configured to engage the first holder member 216 at a plurality of termination points 344 ensuring good electrical connection between the first holder member 216 and the second holder member 218.

In an exemplary embodiment, the first hole 302 is entirely contained within and bounded by the material of the first tab 220. For example, the first hole 302 includes the bridges 290 closing or blocking the first hole 302 from the channels 224 on either side of the first hole 302. The first hole 302 does not include any open sides that open to the channels 224. The bridges 290 extend across the first hole 302 between tab segments 346, 348 defined on opposite sides of the first hole 302. The bridges 290 define a continuous shield structure along the first tab 220, such as from the tab segment 346 to the tab segment 348. The bridges 290 block electrical radiation from propagating across the first hole 302 between the adjacent channels 224 (for example, as compared to a situation having the first hole 302 with open sides rather than the bridges 290, where such open sides could allow electrical radiation leakage across the first hole 302 from one channel 224 to the other channel 224). The bridges 290 have inner edges 350, which may be coplanar with the inner edge 330 of the first tab 220. The bridges 290 and associated tab segments 346, 348 form continuous walls extending across the first hole 302 that define the channels 224 on opposite sides of the first tab 220.

FIG. 7 is a side view of the second holder member 218 formed in accordance with an exemplary embodiment. FIG. 7 illustrates the second tabs 221 extending from the second wall 223 to define the corresponding channels 225.

In an exemplary embodiment, the second holder member 218 includes a plurality of connection features that mechanically and electrically connect the second holder member 218 to the first holder member 216 (shown in FIGS. 4 and 5). The multiple connection features create a reliable electrical connection between the first and second holder members 216, 218 to ensure that the shielding structure is electrically commoned at regular intervals to reduce the ground induced noise resonances that can be present in pair-to-pair cross talk. Having multiple electrical connections reduces the presence of isolated ground structures around the receptacle signal contacts, which may enhance the electrical performance of the receptacle assembly 102 (shown in FIG. 1). Additionally, the second holder member 218 includes electrical radiation reducing features that reduce electrical radiation between the adjacent channels 225. For example, bridges 292 block any openings or gaps in the tabs 221 between the adjacent channels 225. The bridges 292 may make the tabs 221 continuous from the front 226 to the bottom 228. Such electrical radiation reducing features reduce noise resonances between receptacle signal contacts 124 (shown in FIG. 3) in adjacent channels 225 as compared to contact modules that have gaps, spaces or holes in the tabs that would allow electrical radiation therethrough. As such, the electrical radiation reducing features improve performance of the contact module 122 (shown in FIG. 3) as compared to contact modules that have gaps, spaces or holes in the tabs.

In an exemplary embodiment, the connection features include second posts 320 arranged at intervals along the second tabs 221 and second holes 322 arranged at intervals along the second tabs 221. The intervals may be selected to reduce or eliminate frequency noise resonance effects in a particular frequency range or below a predetermined frequency, such as below 12.5 GHz. Any desired frequency range may be targeted and the corresponding spacing between the connection features may be set accordingly.

The second posts 320 are configured to be received in corresponding first holes 302 (shown in FIGS. 4 and 5) in the first holder member 216 while the second holes 322 are configured to receive corresponding posts 300 (shown in FIGS. 4 and 5) extending from the first holder member 216. The posts 320 and holes 322 may be arranged in any sequence, such as an alternating sequence of post-hole-post-hole along the second tab 221. Other sequences are possible in alternative embodiments. Optionally, where the second tab 221 is able to be wider, such as along the bottom, the posts 320 and holes 322 in such region(s) may be enlarged, which may allow the posts 320 to be more robust and reduce the risk of damage.

Optionally, in an alternative embodiment, the second holder member 218 may include only posts 320 or only holes 322. Optionally, the second holder member 218 may include different sized and shaped posts 320 and holes 322 along the second tabs 221. Optionally, the second holder member 218 may include connection features in locations other than along the second tabs 221. For example, in the illustrated embodiment, the second holder member 218 includes outer holes 324 along surfaces of the second holder member 218 outside of the area of the second tabs 221. The outer holes 324 are configured to receive the outer posts 304 (shown in FIGS. 4 and 5) of the first holder member 216.

In an exemplary embodiment, the connection features include second shoulders 326 along the second tabs 221. Each second shoulder 326 may be provided along the lower half of the corresponding second tab 221 and include an upward facing surface 328 that is configured to engage a corresponding first shoulder 306 (shown in FIGS. 4 and 5) of the first holder member 216. The second shoulders 326 may engage the first shoulders 306 to create mechanical and/or electrical connection between the first holder member 216 and the second holder member 218.

Optionally, the second tabs 221 may have different thickness along different sections thereof, with the thickness dimension generally defined across the tab 221 between the adjacent channels 225 on either side of the corresponding tab 221. Optionally, the second posts 320 may have post thicknesses approximately equal to the corresponding tab thicknesses.

Optionally, the second posts 320 may be may be oblong or oval in shape. Alternatively, the second posts 320 may have other shapes, such as circular, rectangular or other shapes. The second posts 320 may be elongated along the length of the tab 221, with the length of the tab 221 being defined in a direction generally parallel to the channels 225. The second posts 320 may be tapered. For example, each post 320 may be wider at the base of the post 320 and narrower at the tip of the post 320. The posts 320 may have chamfered lead-ins at the tip to help guide the posts 320 into the corresponding holes 302 in the first holder member 216 (shown in FIGS. 4 and 5).

The second tabs 221 extend inward from the second wall 223 to an inner edge 360. The second post 320 extends from the inner edge 360. In the illustrated embodiment, the second post 320 has an oval cross section; however, other shapes are possible in alternative embodiments. The second post 320 is sized and shaped to fit in the corresponding first hole 302 when the first holder member 216 is coupled to the second holder member 218. The second post 320 is similar to the first post 300 and like components may be identified with like reference numbers.

The second hole 322 is sized and shaped to receive one of the first posts 300. In an exemplary embodiment, the second hole 322 is similar to the first hole 302 and like components may be identified with like reference numbers. For example, the second hole 322 is bounded by a plurality of the flat walls 332 and includes undercuts 334. The interference tabs 342 define multiple termination points 344 for mechanical and electrical connection to the first post 300. The bridges 292 extend across the sides of the second holes 322 to close off the second holes 322 from the adjacent channels 225. The bridges 292 define continuous walls with tab segments 362, 364 of the second tab 221 arranged on opposite sides of the second hole 322. The bridges 292 block electrical radiation across the second hole 322 between the adjacent channels 225.

Figure 8:
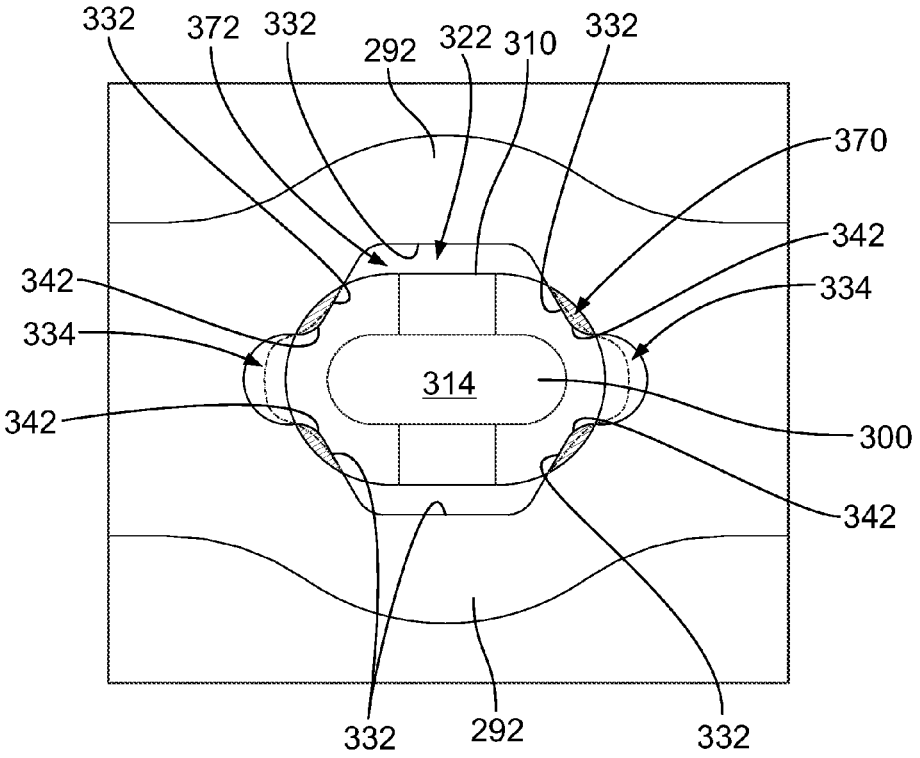
FIG. 8 is a schematic illustration of the holder members being coupled together.

FIG. 8 is a schematic illustration of the first post 300 positioned relative to the second hole 322 showing interference between the first post 300 and the second hole 322 due to size and shape differences between the first post 300 and the second hole 322. The shaded regions 370 represent the overlap or interference at the interference tabs 342. The oblong shape of the first post 300 positions portions of the outer perimeter 310 of the first post 300 beyond the flat walls 332. As the tip 314 of the first post 300 is loaded into the second hole 322, the first post 300 engages the interference tabs 342 and portions of the first post 300 and/or portions of the interference tabs 342 are compressed, creating an interference fit between the first post 300 and the interference tabs 342. As the first post 300 is compressed, the shape of the first post 300 changes and portions of the first post 300 may swell into the undercuts 334 (indicated by the dashed lines showing the changed shapes of the first post 300 and the interference tabs 342). The undercuts 334 are void spaces that accommodate the swollen first post 300. In an exemplary embodiment, the second hole 322 may include gaps 372 between the outer perimeter 310 of the first post 300 and the bridges 292. Portions of the first post 300 may swell into the gaps 372. The gaps 372 are void spaces that accommodate the swollen first post 300.

Figure 9:
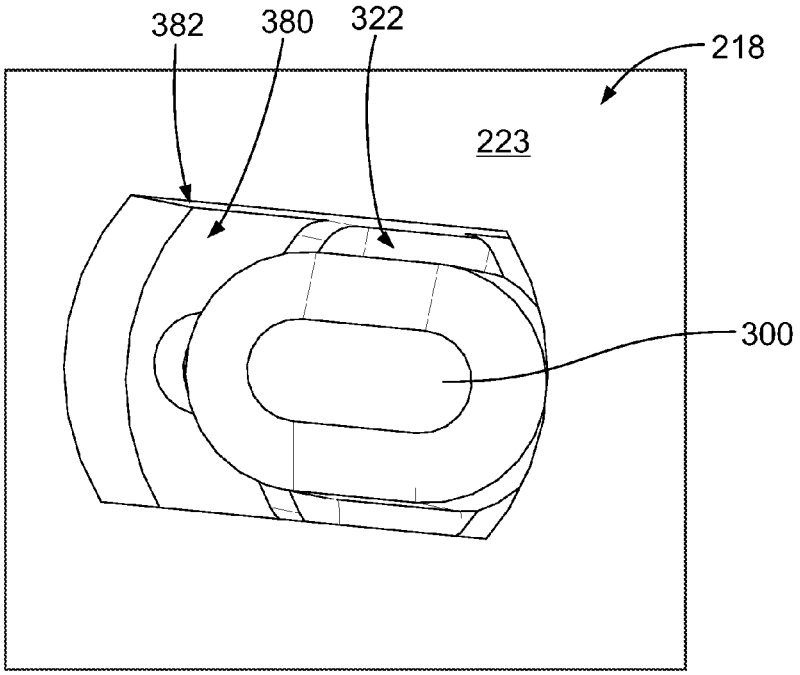
FIG. 9 is a side view of a portion of the contact module showing the holder members coupled together.

FIG. 9 is a side view of a portion of the contact module 122 showing the first post 300 loaded into the corresponding second hole 322. In an exemplary embodiment, the second hole 322 includes a counterbore 380 at an outer end or rear 382 of the second hole 322. The rear 382 is generally opposite the inner edge 360 (shown in FIG. 7). The rear 382 may be at the second wall 223 and the counterbore 380 may be formed in the exterior of the second wall 223. The counterbore 380 provides a relief area for the first post 300 to swell and/or return to its normal shape. The counterbore 380 is shaped differently than the second hole 322 and, when the first post 300 swells and/or returns to the normal shape, the first post 300 may be mechanically secured in the second holder member 218 due to interference with portions of the second holder member 218, such as the interference tabs 342 (shown in FIG. 8).

Figure 10:
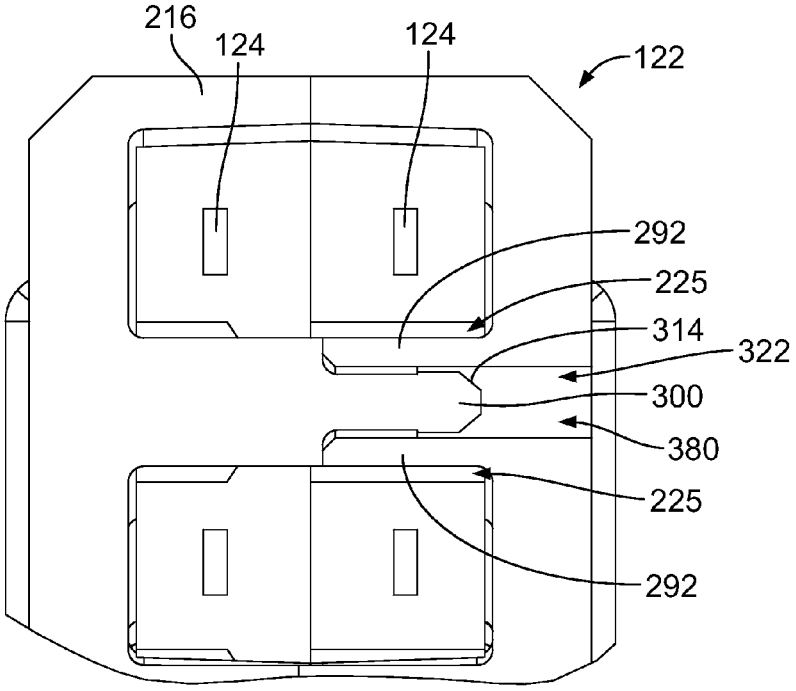
FIG. 10 is a cross sectional view of a portion of the contact module showing the holder members being coupled together.

FIG. 10 is a cross sectional view of a portion of the contact module 122 showing the first post 300 in the second hole 322. The tip 314 of the first post 300 is in the counterbore 380. The bridges 292 are shown extending to the first holder member 216. The bridges 292 form continuous walls between the circuits or data channels defined by the receptacle signal contacts 124. For example, even if the first post 300 were to break off, there is shield structure, namely the bridges 292 between the channels 225. The second holes 322 are not open to both channels 225, but rather are covered by the bridges 292 which extend across the second holes 322.

Figure 11:
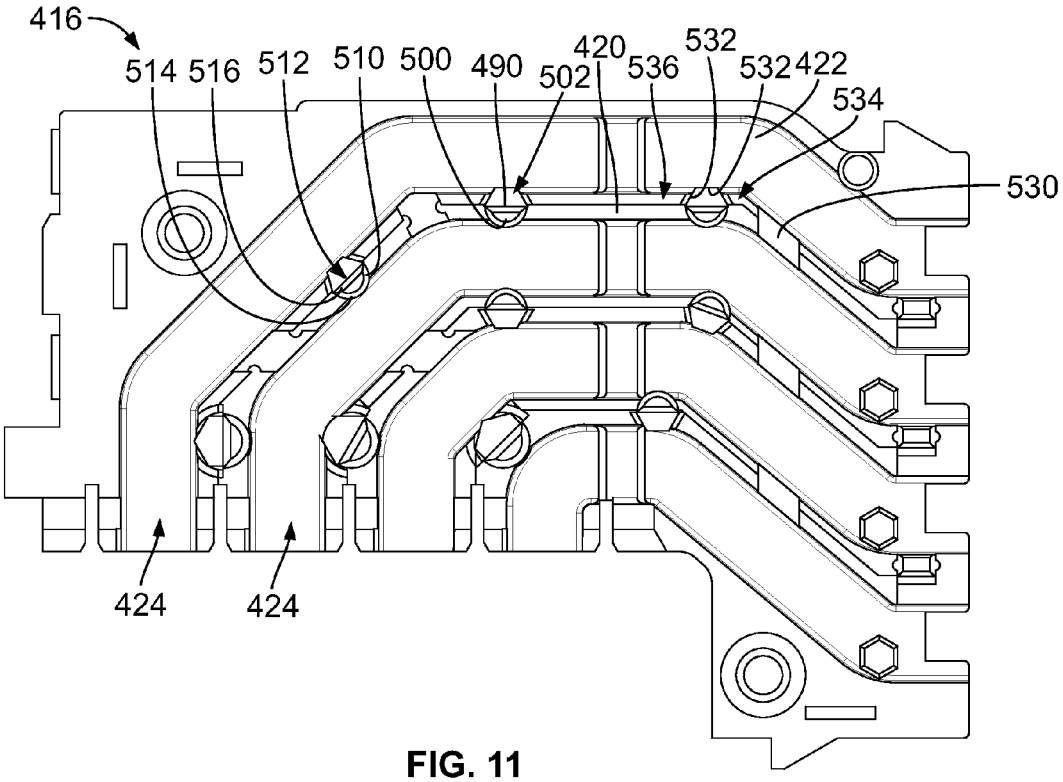
FIG. 11 is a side view of a holder member formed in accordance with an exemplary embodiment.
Figure 12:
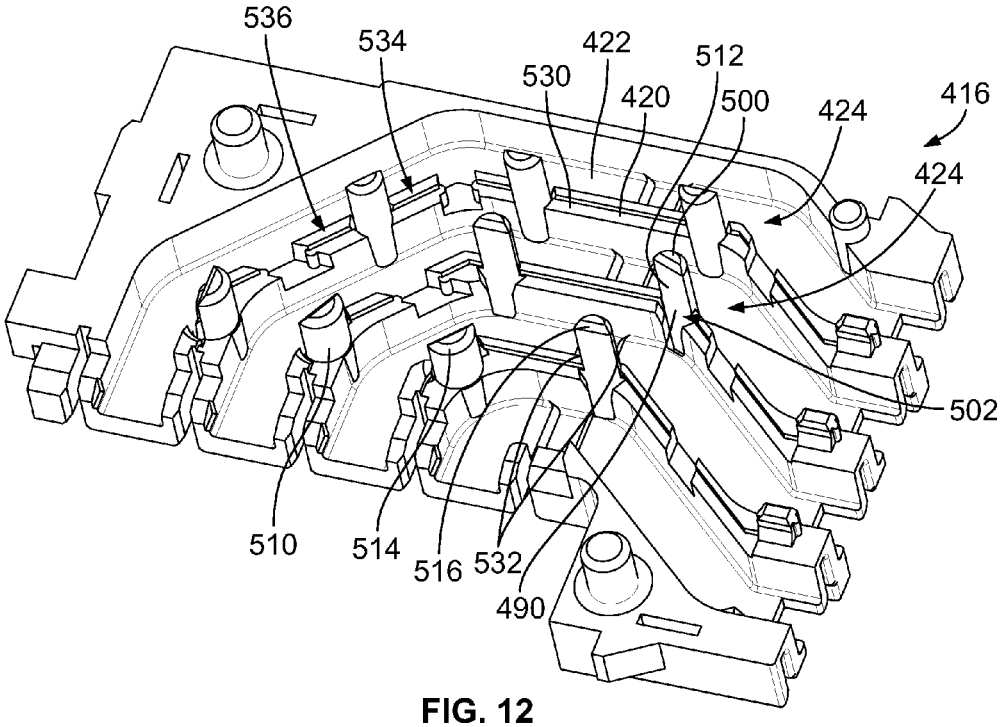
FIG. 12 is a perspective view of the holder member shown in FIG. 11.
Figure 13:
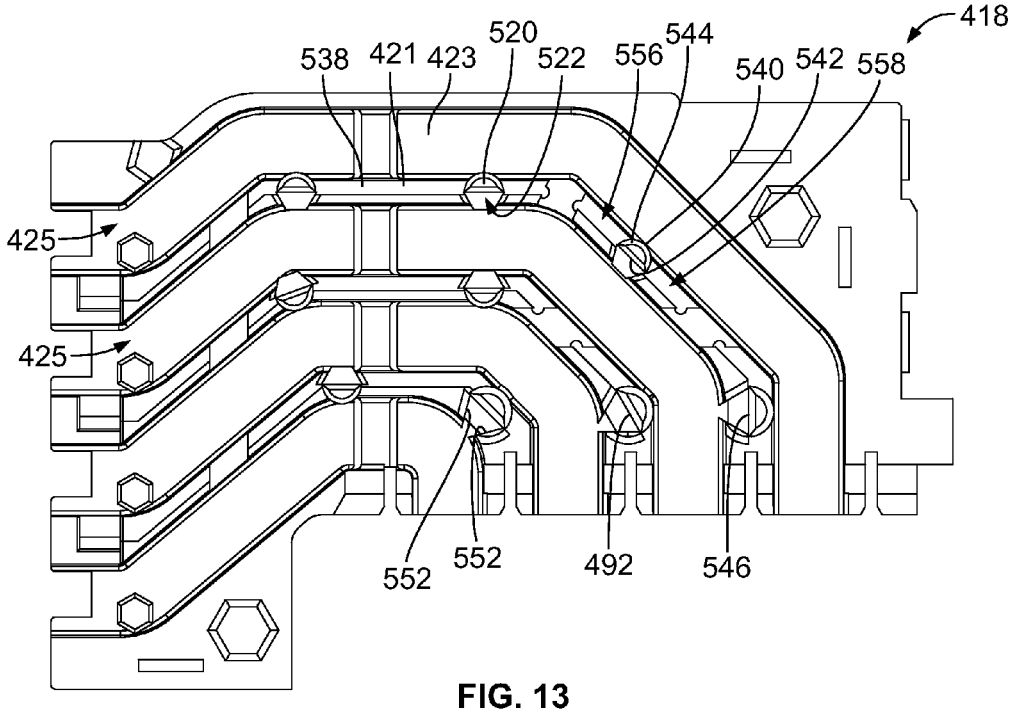
FIG. 13 is a side view of a holder member formed in accordance with an exemplary embodiment.

FIG. 11 is a side view of a first holder member 416 formed in accordance with an exemplary embodiment and configured to be mated with a second holder member 418 (shown in FIG. 13). FIG. 12 is a perspective view of the first holder member 416. The first holder member 416 may be similar to the first holder member 216 (shown in FIGS. 4 and 5) and some components of the first holder member 416 are not described in detail as they were described above with reference to the first holder member 216. The first holder member 416 includes first tabs 420 extending from a first wall 422 to define corresponding channels 424.

In an exemplary embodiment, the first holder member 416 includes a plurality of connection features that mechanically and electrically connect the first holder member 416 to the second holder member 418 (shown in FIG. 13). The first holder member 416 forms part of a shielding structure for the frame assembly 230 (shown in FIG. 2). The first holder member 416 includes electrical radiation reducing features that reduce electrical radiation between the channels 424. For example, bridges 490 block any openings or gaps in the tabs 420 between channels 424. The bridges 490 may make the tabs 420 continuous such that there are no openings between the channels 424.

In an exemplary embodiment, the connection features include first posts 500 and first holes 502 arranged at intervals along the first tabs 420. The first posts 500 are configured to be received in corresponding holes 522 (shown in FIG. 13) in the second holder member 418 while the first holes 502 are configured to receive corresponding posts 520 (shown in FIG. 13) extending from the second holder member 418. In an exemplary embodiment, the posts 500 and holes 502 are aligned with each other at the same location along the first tabs 420. For example, the first posts 500 are half-posts and the first holes 502 are half-holes.

The first tabs 420 extend inward from the first wall 422 to an inner edge 530. The first post 500 extends from the inner edge 530. The first post 500 is sized and shaped to fit in the corresponding second hole 522 when the first holder member 416 is coupled to the second holder member 418 (shown in FIG. 13). The first posts 500 have an outer perimeter 510 and a flat mating wall 512 that faces the first hole 502. Optionally, the first posts 500 are semi-circular in shape; however, the first posts 500 may have other shapes. The flat mating walls 512 may extend generally parallel to the channels 424 on opposite sides of the first posts 500. The posts 500 may be tapered and may include chamfered lead-ins 514 to the outer perimeter 510 and/or a chamfered lead-in 516 to the flat mating wall 512.

In an exemplary embodiment, the first post 500 defines the bridge 490 extending across the corresponding first hole 502. For example, the flat mating wall 512 may span entirely across the first hole 502 between the opposite tab segments on opposite sides of the first hole 502.

The first hole 502 is sized and shaped to receive one of the second posts 520 (shown in FIG. 13). In an exemplary embodiment, the first hole 502 is semi-hexagonal shaped bounded by a plurality of flat walls 532 and bounded by the flat mating wall 512 of the first post 500; however other polygonal shaped holes may be used in alternative embodiments having a different number of flat walls 532. In other alternative embodiments, the first hole 502 may be semi-circular in shape also being bounded by the flat mating wall 512. The flat walls 532 are configured to engage the second post 520 received in the first hole 502. The flat walls 532 define termination points between the first holder member 416 and the second holder member 418 (shown in FIG. 13).

In an exemplary embodiment, the first hole 502 is open to one of the channels 424, however the other channel 424 is blocked by the corresponding bridge 490 defined by the associated first post 500. The bridge 490 closes or blocks the first hole 502 from one of the channels 424, thus defining a continuous ground circuit or shield structure between the channels 424. In other words, the first tabs 420 do not include any openings or gaps between the channels 424. The bridges 490 extend across the first holes 502 between tab segments 534, 536 defined on opposite sides of the first holes 502. The bridges 490 define continuous shield structures along the first tabs 420, such as from the tab segments 534 to the associated tab segments 536. The bridges 490 block electrical radiation from propagating across the first holes 502 between the adjacent channels 424.

FIG. 13 is a side view of the second holder member 418 formed in accordance with an exemplary embodiment. FIG. 13 illustrates second tabs 421 extending from a second wall 423 to define the corresponding channels 425. The second holder member 418 may be similar to the second holder member 218 (shown in FIG. 7) and some components of the second holder member 418 are not described in detail as they were described above with reference to the second holder member 218.

The second holder member 418 includes electrical radiation reducing features that reduce electrical radiation between the adjacent channels 425. For example, bridges 492 block any openings or gaps in the tabs 421 between the adjacent channels 425. The bridges 492 may make the tabs 421 continuous such that there are no openings between the channels 425.

In an exemplary embodiment, the connection features include second posts 520 and second holes 522 arranged at intervals along the second tabs 421. The second posts 520 are configured to be received in corresponding first holes 502 (shown in FIGS. 11 and 12) in the first holder member 416 while the second holes 522 are configured to receive corresponding posts 500 (shown in FIGS. 11 and 12) extending from the first holder member 416. In an exemplary embodiment, the posts 520 and holes 522 are aligned with each other at the same location along the second tabs 421. For example, the second posts 520 are half-posts and the second holes 522 are half-holes.

The second tabs 421 extend inward from the second wall 423 to an inner edge 538. The second post 520 extends from the inner edge 538. The second post 520 is sized and shaped to fit in the corresponding first hole 502 when the second holder member 418 is coupled to the first holder member 416 (shown in FIGS. 11 and 12). The second posts 520 have an outer perimeter 540 and a flat mating wall 542 that faces the second hole 522. Optionally, the second posts 520 are semi-circular in shape; however, the second posts 520 may have other shapes. The flat mating walls 542 may extend generally parallel to the channels 525 on opposite sides of the second posts 520. The second posts 520 may be tapered and may include chamfered lead-ins 544 to the outer perimeter 540 and/or a chamfered lead-in 546 to the flat mating wall 542.

In an exemplary embodiment, the second post 520 defines the bridge 492 extending across the corresponding second hole 522. For example, the flat mating wall 542 may span entirely across the second hole 522 between tab segments 556, 558 on opposite sides of the second hole 522.

The second hole 522 is sized and shaped to receive one of the first posts 500 (shown in FIGS. 11 and 12). In an exemplary embodiment, the second hole 522 is semi-hexagonal shaped bounded by a plurality of flat walls 552 and bounded by the flat mating wall 542 of the second post 520; however other polygonal shaped holes may be used in alternative embodiments having a different number of flat walls 552. In other alternative embodiments, the second hole 522 may be semi-circular in shape also being bounded by the flat mating wall 542. The flat walls 552 are configured to engage the first post 500 received in the second hole 522. The flat walls 552 define termination points between the first holder member 416 and the second holder member 418.

In an exemplary embodiment, the second hole 522 is open to one of the channels 425, however the other channel 425 is blocked by the corresponding bridge 492 defined by the associated second post 520. The bridge 492 closes or blocks the second hole 522 from one of the channels 425, thus defining a continuous ground circuit or shield structure between the channels 425. In other words, the second tabs 421 do not include any openings or gaps between the channels 425. The bridges 492 extend across the second holes 522 between the tab segments 556, 558 defined on opposite sides of the second holes 522. The bridges 492 define continuous shield structures along the second tabs 421, such as from the tab segments 556 to corresponding tab segments 558. The bridges 492 block electrical radiation from propagating across the second holes 522 between the adjacent channels 425.

Figure 14:
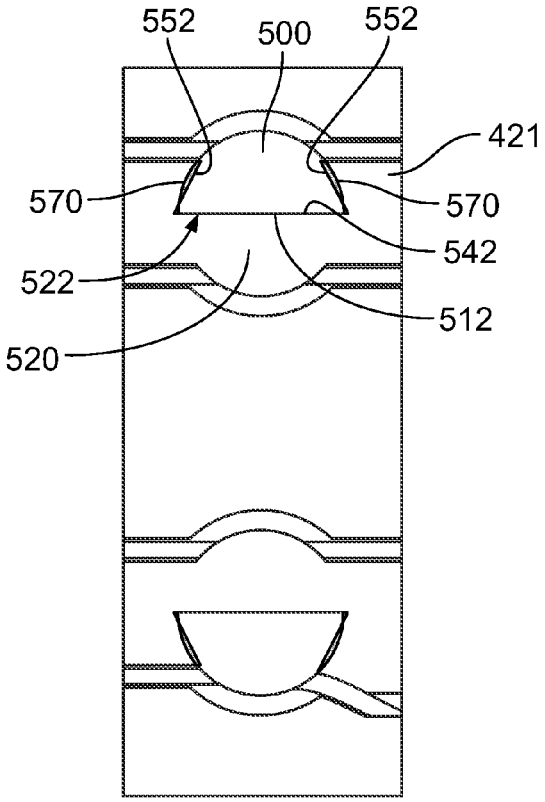
FIG. 14 is a schematic illustration of the of the holder members shown in FIGS. 11-13 being coupled together.

FIG. 14 is a schematic illustration of the first post 500 positioned relative to the second hole 522 showing interference between the first post 500 and the second hole 522 due to size and shape differences between the first post 500 and the second hole 522. Shaded regions 570 represent overlap between the first post 500 and the second hole 522. The shape of the second hole 522 forces the first post 500 against the second post 520. For example, the flat mating wall 512 of the first post 500 is pressed against the flat mating wall 542 of the second post 520. The flat walls 552 are angled to press the first post 500 against the second post 520. As the first post 500 is loaded into the second hole 522, the first post 500 and/or portions of the walls 552 may be compressed, creating an interference fit between the first post 500 and the second tab 421.

Figure 15:
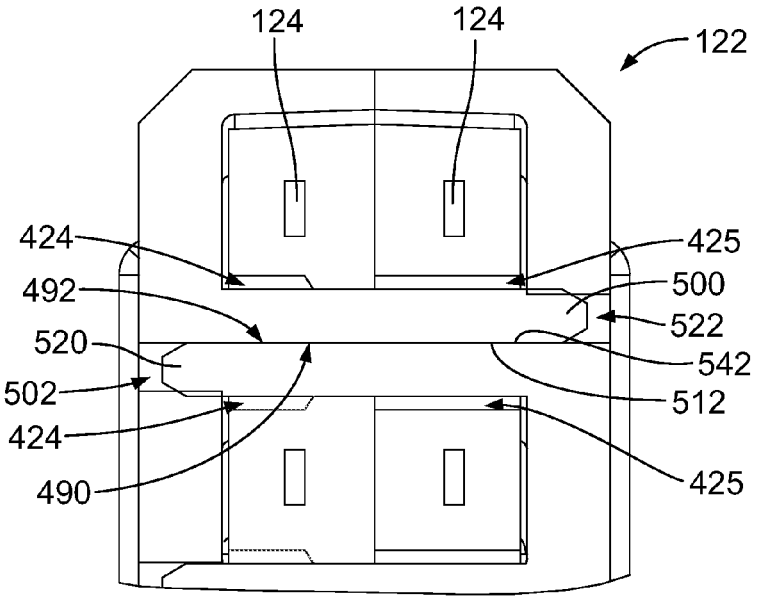
FIG. 15 is a cross sectional view of a portion of the contact module showing the holder members shown in FIGS. 11-13 coupled together.

FIG. 15 is a cross sectional view of a portion of the contact module 122 showing the first post 500 in the second hole 522 and the second post 520 in the first hole 502. The flat mating walls 512, 542 are electrically connected together. The flat mating walls 512, 542 define the bridges 490, 492, respectively. The bridges 490, 492 form continuous walls between the circuits or data channels defined by the receptacle signal contacts 124. For example, even if one of the posts 500, 520 were to break off, there is shield structure, namely the bridge 490 or 492 of the other post 500, 520 between the channels 425.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A connector assembly comprising:

a contact module comprising a conductive holder and a frame assembly held by the conductive holder;

the conductive holder comprising a first holder member and second holder member coupled to the first holder member, the first and second holder members being electrically connected to one another, the conductive holder having a chamber between the first and second holder members, the chamber being divided into a plurality of channels by first tabs of the first holder member and second tabs of the second holder member, the first tabs having posts extending therefrom, the second tabs having holes receiving the posts of the first tabs, the second tabs having tab segments on opposite sides of the associated holes, each hole having a bridge extending across the hole between the tab segments on opposite sides of the associated hole, the bridge blocking electrical radiation across the hole between the adjacent channels;

the frame assembly comprising at least one dielectric frame received in the first and second holder members, each dielectric frame comprising a plurality of contacts and frame members supporting the contacts, the contacts being routed through corresponding channels, the first and second tabs disposed between corresponding frame members, the bridges disposed between corresponding frame members.

2. The connector assembly of claim 1, wherein the second tabs have inner edges, the bridges having inner edges, the inner edges of the second tab and the inner edges of the bridges defining continuous walls across the holes.

3. The connector assembly of claim 1, wherein each hole is separated from at least one of the adjacent channels by the corresponding bridges.

4. The connector assembly of claim 1, wherein the holes are separated from both adjacent channels by the corresponding bridges.

5. The connector assembly of claim 1, wherein the holes have undercuts wider than the posts, the posts being compressed in the holes such that a portion of each post swells into the associated undercut.

6. The connector assembly of claim 1, wherein the holes have counterbores at corresponding rears of the holes, the posts being compressed in the holes, portions of the posts received in the counterbores swelling into the counterbores to mechanically hold the posts in the holes.

7. The connector assembly of claim 1, wherein the holes have interference tabs at least partially compressed by corresponding posts when the posts are received in the holes.

8. The connector assembly of claim 1, wherein the posts are oblong and the holes have a plurality of flat walls each defining termination points with the corresponding posts.

9. The connector assembly of claim 1, wherein each first tab includes first holes and the holes in the second tabs define second holes, the posts extending from the first tabs defining first posts, and wherein each second tab includes second posts extending therefrom.

10. The connector assembly of claim 9, wherein the second posts define the bridges.

11. The connector assembly of claim 9, wherein the first and second posts engage each other.

12. The connector assembly of claim 9, wherein the first posts and first holes are aligned between corresponding tab segments of the first tabs and the second posts and second holes are aligned between corresponding tabs segments of the second tabs.

13. A connector assembly comprising:

a contact module comprising a conductive holder and a frame assembly held by the conductive holder;

the conductive holder comprising a first holder member and second holder member coupled to the first holder member, the first holder member having a first wall with a plurality of first tabs extending from the first wall toward the second holder member, the first tabs having inner edges facing the second holder member, the first tabs having first posts extending from the inner edges, first channels being defined between each of the first tabs, the second holder member having a second wall with a plurality of second tabs extending from the second wall toward the first holder member, the second tabs having inner edges facing the first holder member, second channels being defined between each of the second tabs, the second tabs having second holes through the second tabs and bridges extending across the second holes to block the second holes from at least one of the adjacent channels, the bridges blocking electrical radiation across the corresponding second hole between the adjacent channels, the second holes receiving the first posts of the first tabs such that each first post engages portions of the second tab surrounding the corresponding second hole to electrically connect the first and second holder members;

the frame assembly comprising at least one dielectric frame received in the first and second holder members, each dielectric frame comprising a plurality of contacts and frame members supporting the contacts, the contacts being routed through corresponding channels, the first and second tabs disposed between corresponding frame members, the bridges disposed between corresponding frame members.

14. The connector assembly of claim 13, wherein the second holes have undercuts wider than the first posts, the first posts being compressed in the second holes such that a portion of each first post swells into the associated undercut.

15. The connector assembly of claim 13, wherein the second holes have counterbores at corresponding rears of the second holes, the first posts being compressed in the second holes, portions of the first posts received in the counterbores swelling into the counterbores to mechanically hold the first posts in the second holes.

16. The connector assembly of claim 13, wherein the second holes have interference tabs at least partially compressed by corresponding first posts when the first posts are received in the second holes.

17. The connector assembly of claim 13, wherein each first tab includes first holes, and wherein each second tab includes second posts extending therefrom.

18. The connector assembly of claim 17, wherein the second posts define the bridges.

19. The connector assembly of claim 17, wherein the first and second posts engage each other.

20. The connector assembly of claim 17, wherein the first posts and first holes are aligned between corresponding tab segments of the first tabs and the second posts and second holes are aligned between corresponding tabs segments of the second tabs.

* * * * *